US010249287B2

(12) United States Patent
Otsuka et al.

(10) Patent No.: US 10,249,287 B2
(45) Date of Patent: Apr. 2, 2019

(54) NOISE-CANCELLING HEADPHONE

(71) Applicant: Kabushiki Kaisha Audio-Technica, Tokyo (JP)

(72) Inventors: Koji Otsuka, Tokyo (JP); Yumi Shimazaki, Tokyo (JP); Daisuke Yoneyama, Tokyo (JP)

(73) Assignee: KABUSHIKI KAISHA AUDIO-TECHNICA, Tokyo (JP)

( * ) Notice: Subject to any disclaimer, the term of this patent is extended or adjusted under 35 U.S.C. 154(b) by 0 days.

(21) Appl. No.: 15/952,779

(22) Filed: Apr. 13, 2018

(65) Prior Publication Data

US 2018/0366100 A1 Dec. 20, 2018

(30) Foreign Application Priority Data

Jun. 19, 2017 (JP) ..... 2017-119455

(51) Int. Cl.
*H04R 1/10* (2006.01)
*H04R 5/027* (2006.01)
*G10K 11/178* (2006.01)

(52) U.S. Cl.
CPC .. *G10K 11/17823* (2018.01); *G10K 11/17857* (2018.01); *G10K 11/17875* (2018.01); *G10K 11/17881* (2018.01); *H04R 1/1083* (2013.01); *G10K 2210/1081* (2013.01); *G10K 2210/3026* (2013.01); *G10K 2210/3044* (2013.01);
(Continued)

(58) Field of Classification Search
CPC ..... H04R 1/1083; H04R 1/1008; G10K 11/17857; G10K 11/1788; G10K 2210/1081; G10K 2210/3027
USPC ..... 381/74, 71.1–71.6, 94.1–94.4, 94.7, 381/71.11–71.14, 25, 322, 328, 317, 367, 381/354, 94
See application file for complete search history.

(56) References Cited

U.S. PATENT DOCUMENTS 6,118,878 A * 9/2000 Jones ..... G10K 11/17855 381/72
8,447,045 B1 5/2013 Laroche
(Continued)

FOREIGN PATENT DOCUMENTS

JP 2012023637 A 2/2012

OTHER PUBLICATIONS

European Search Report, 18166566.2, Audio-Technica Corporation, dated Oct. 12, 2018.

*Primary Examiner* — Lun-See Lao
(74) *Attorney, Agent, or Firm* — W&C IP

(57) ABSTRACT

A headphone includes a feedback microphone that receives a front air chamber sound including an external sound, the feedback microphone being provided on a front air chamber side, a driver unit that emits a noise-canceling sound into the front air chamber, the noise-canceling sound canceling at least a part of the sound included in the front air chamber sound received by the feedback microphone, a balanced microphone that receives the noise-canceling sound emitted from the driver unit, the balanced microphone being provided in a region on a side of the driver unit opposite the front air chamber, and a sound generating part that generates the noise-canceling sound by adding a signal based on the noise-canceling sound received by the balanced microphone to a signal based on the front air chamber sound received by the feedback microphone.

15 Claims, 7 Drawing Sheets

(52) U.S. Cl.
CPC .... *G10K 2210/3046* (2013.01); *H04R 1/1008* (2013.01); *H04R 5/027* (2013.01)

(56) References Cited

U.S. PATENT DOCUMENTS

| | | | | |
|---|---|---|---|---|
| 8,472,637 | B2 * | 6/2013 | Carreras | G10L 21/0208 381/71.14 |
| 9,445,184 | B2 * | 9/2016 | Ring | H04R 1/1083 |
| 2012/0014532 | A1 * | 1/2012 | Kimura | H04R 1/1083 381/71.6 |
| 2015/0154950 | A1 | 6/2015 | Ring | |

* cited by examiner

NOISE-CANCELLING HEADPHONE

CROSS-REFERENCE TO RELATED APPLICATIONS

The present application claims priority to Japanese Patent Application number 2017-119455, filed on Jun. 19, 2017. The contents of this application are incorporated herein by reference in their entirety.

TECHNICAL FIELD

The present invention relates to a headphone with a noise-canceling function.

BACKGROUND ART

Conventionally, headphones with a noise-canceling function to cancel external noise are known. Japanese Unexamined Patent Publication No. 2012-023637 discloses a technique that attenuates noise by driving a driver unit with a noise-canceling signal which cancels noise from outside collected by a microphone in a front air chamber provided between a housing of a headphone and an ear of a user.

Although a headphone that cancels external noise with a feedback system attenuates external noise, not all noise is eliminated due to a variety of causes like sound reflection inside an ear cup and characteristics of a microphone and a driver unit. Furthermore, the noise-canceling signal may include components that cannot cancel the external noise since the noise-canceling sound emitted from the driver unit is collected by the microphone. As a result, the noise-eliminating effect of the noise-canceling function was diminished. Improvement of the noise-eliminating effect of the noise-canceling function is desired.

BRIEF SUMMARY OF THE INVENTION

This invention focuses on these points, and an object of the invention is to improve a noise-removal capability of a headphone.

A headphone according to the present invention includes a first microphone that receives a front air chamber sound including an external sound, the first microphone being provided on a front air chamber side, a driver unit that emits a noise-canceling sound into the front air chamber, the noise-canceling sound canceling at least a part of the external sound included in the front air chamber sound received by the first microphone, a second microphone that receives the noise-canceling sound emitted from the driver unit, the second microphone being provided in a region on a side of the driver unit opposite the front air chamber, and a sound generating part that generates the noise-canceling sound by adding a signal based on the noise-canceling sound received by the second microphone to a signal based on the front air chamber sound received by the first microphone.

DETAILED DESCRIPTION OF THE INVENTION

Hereinafter, the present invention will be described through exemplary embodiments of the present invention, but the following exemplary embodiments do not limit the invention according to the claims, and not all of the combinations of features described in the exemplary embodiments are necessarily essential to the solution means of the invention.

[Outline of a Noise Canceling Method]

Figure 1:
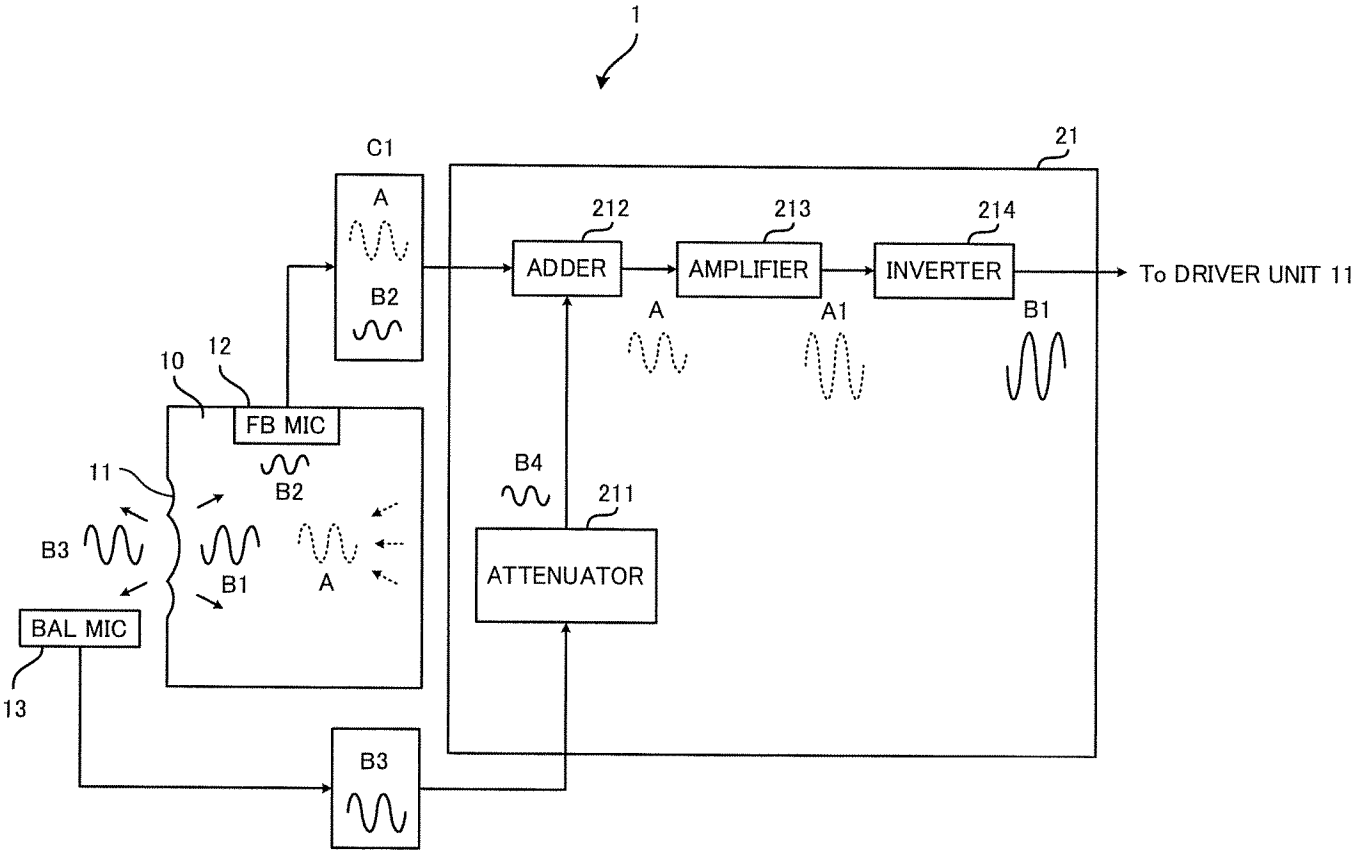
FIG. 1 illustrates a noise-canceling method in a headphone according to the exemplary embodiment.

FIG. 1 illustrates a noise-canceling method in a headphone 1 according to the exemplary embodiment. The headphone 1 includes a driver unit 11, a feedback microphone 12, and a balanced microphone 13. The headphone 1 further includes a sound generating part 21 which generates noise-canceling sound to cancel external noise. The sound generating part 21 includes an attenuator 211, an adder 212, an amplifier 213, and an inverter 214. The sound generating part 21 generates the noise-canceling sound by adding a signal based on the noise canceling sound received by the balanced microphone 13 to a signal based on the front air chamber sound received by the feedback microphone 12.

The driver unit 11 emits a sound to a front air chamber 10 which is formed on the front side of the driver unit 11 between an ear cup and an ear of a user when the headphone 1 is in use. The feedback microphone 12, which is the first microphone, is provided in the front air chamber 10. The feedback microphone 12 receives the front air chamber sound including external sounds in the front air chamber 10, and then converts the front air chamber sound into an electrical signal. As shown in FIG. 1, the feedback microphone 12 receives the front air chamber sound that includes an external sound A and an attenuated noise-canceling sound B2 which is generated by attenuating a noise-canceling sound B1 emitted from the driver unit 11. The feedback microphone 12 converts the front air chamber sound into an electrical signal, and then outputs the front air chamber signal C1, which is the converted electrical signal, to the adder 212.

The balanced microphone 13, which is the second microphone, is provided on the back side of the driver unit 11, that is, on the opposite side of the front air chamber 10. The balanced microphone 13 receives the sound emitted from the back side of the driver unit 11, and converts the received sound into an electrical signal. The phase of the sound emitted from the back side of the driver unit 11 is opposite to the phase of the sound emitted from the front side of the driver unit 11 to the front air chamber 10. Therefore, the balanced microphone 13 receives an inverted noise-canceling sound B3 which has the same frequency as and an inverted phase of the noise-canceling sound B1. The balanced microphone 13 converts the inverted noise-canceling sound B3 into an electrical signal and outputs the electrical signal to the attenuator 211.

The attenuator 211 generates an attenuated signal B4 by attenuating the electrical signal based on the inverted noise-canceling sound B3 input from the balanced microphone 13. The attenuation amount in the attenuator 211 is the same as the attenuation amount with which the noise-canceling sound B1 is attenuated in the process of becoming the attenuated noise-canceling sound B2 by traveling from the driver unit 11 to the feedback microphone 12. In other words, the attenuation rate of the electrical signal in the attenuator 211 is obtained by dividing the attenuated noise-canceling sound B2, that is, the noise-canceling sound B1 at the time of arriving at the feedback microphone 12, by the noise-canceling sound B1 (B2/B1). The attenuator 211 outputs the attenuated signal B4 to the adder 212.

The adder 212 adds the attenuated signal B4 input from the attenuator 211 to the front air chamber signal C1 input from the feedback microphone 12. The attenuated signal B4 is the electrical signal based on a sound generated by attenuating the inverted noise-canceling sound B3 in the attenuator 211. The attenuated signal B4 has the same frequency as, the same level as, and the opposite phase of the signal based on the attenuated noise-canceling sound B2 included in the front air chamber signal C1. Therefore, the adder 212 can generate a signal from the external sound A by canceling the signal based on the attenuated noise-canceling sound B2 included in the front air chamber signal C1 by means of adding the attenuated signal B4 to the front air chamber signal C1. The adder 212 outputs the signal based on the external sound A to the amplifier 213.

The amplifier 213 generates an amplified signal A1 having approximately the same level as the residual noise level in the front air chamber 10 by amplifying the signal based on the external sound A input from the adder 212. The amplifier 213 outputs the generated amplified signal A1 to the inverter 214.

The inverter 214 generates the noise-canceling sound B1 by inverting the signal input from the amplifier 213. The driver unit 11 emits the generated noise-canceling sound B1. An audio signal and the signal based on the noise-canceling sound B1 which is output from the audio generating part 21 are added to the driver unit 11.

[Configuration of the Ear Cup 2]

Figure 2A:
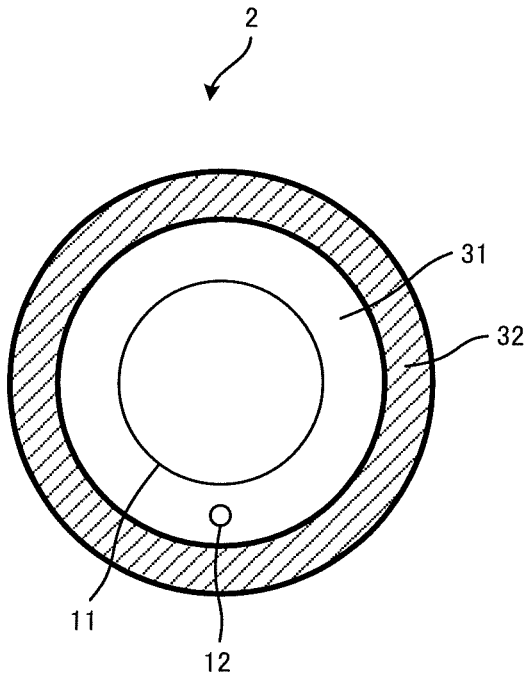
FIGS. 2A and 2B each show a configuration of an ear cup of the headphone.
Figure 2B:
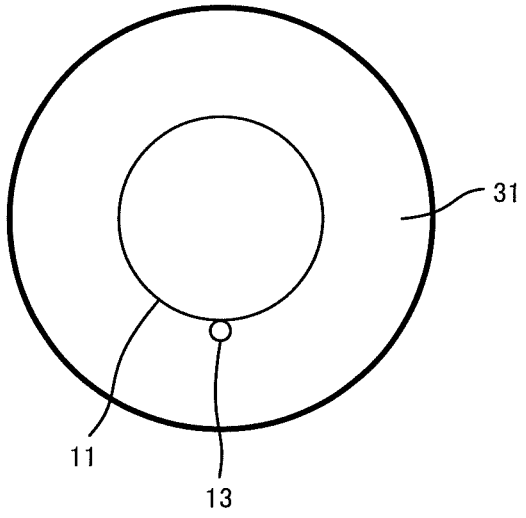

FIGS. 2A and 2B show the configuration of an ear cup 2 of the headphone 1. The ear cup 2 includes a housing 31 and an ear pad 32. FIG. 2A shows the ear cup 2 seen from the side of a user's ear. FIG. 2B shows the ear cup 2 seen towards the side of the user's ear. As shown in FIG. 2A, the feedback microphone 12 is provided near the driver unit 11 on the front side of the driver unit 11.

As shown in FIG. 2B, the balanced microphone 13 is provided near the driver unit 11 in a region on the side of the driver unit 11 opposite the feedback microphone 12. For example, the balanced microphone 13 is provided in an area where the diaphragm is provided on the back surface of the driver unit 11. Due to this configuration that the balanced microphone 13 is provided near the diaphragm, the noise-canceling performance is improved since the phase deviation between the noise-canceling sound B1 emitted from the driver unit 11 and the inverted noise-canceling sound B3 received by the balanced microphone 13 can be reduced.

The balanced microphone 13 can be embedded in the driver unit 11 in order to minimize the phase deviation between the noise-canceling sound B1 emitted from the driver unit 11 and the inverted noise-canceling sound B3 received by the balanced microphone 13. For example, the balanced microphone 13 is fixed to the driver unit 11 near a center position of the diaphragm, the center position being on a back side of the diaphragm.

The distance between the balanced microphone 13 and the center of the driver unit 11 is preferably less than the distance between the feedback microphone 12 and the center of the driver unit 11. This configuration of the ear cup 2 results in a phase difference of approximately 180 degrees between the phase of the inverted noise-canceling sound B3 collected by the balanced microphone 13 and the phase of the noise-canceling sound B1 emitted from the driver unit 11. This configuration lowers the level of the noise-canceling sound received by the feedback microphone 12 and raises the level of the noise-canceling sound received by the balanced microphone 13. As a result, the noise-canceling performance can be improved.

[Experiments to Verify Effects]

Figure 3:
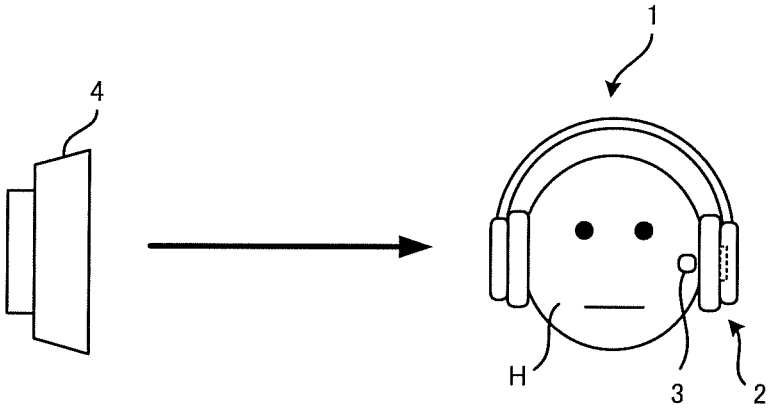
FIG. 3 illustrates an experiment method for verifying an effect of the ear cup.

FIG. 3 illustrates an experiment method for verifying the effect of the ear cup 2. A dummy head H (HATS) imitating a human head is used as a measuring tool in this experiment. The dummy head H has a measurement microphone 3 for measurement inside its pseudo-auricle. The signal collected by the measurement microphone 3 corresponds to the signal which reaches an ear drum of a person.

The level of noise collected by the measurement microphone 3 was measured while a speaker 4 was emitting pink noise and the headphone 1 according to the exemplary embodiment with its noise-canceling function on was attached to the dummy head H. In this experiment, the gain of the feedback microphone 12 was changed, and noise-canceling performance with each gain was measured. The attenuation of the attenuator 211 was changed when the gain of the feedback microphone 12 was changed, since the level of the electrical signal based on the attenuated noise-canceling sound B2 increases as the gain of the feedback microphone 12 increases.

Figure 4:
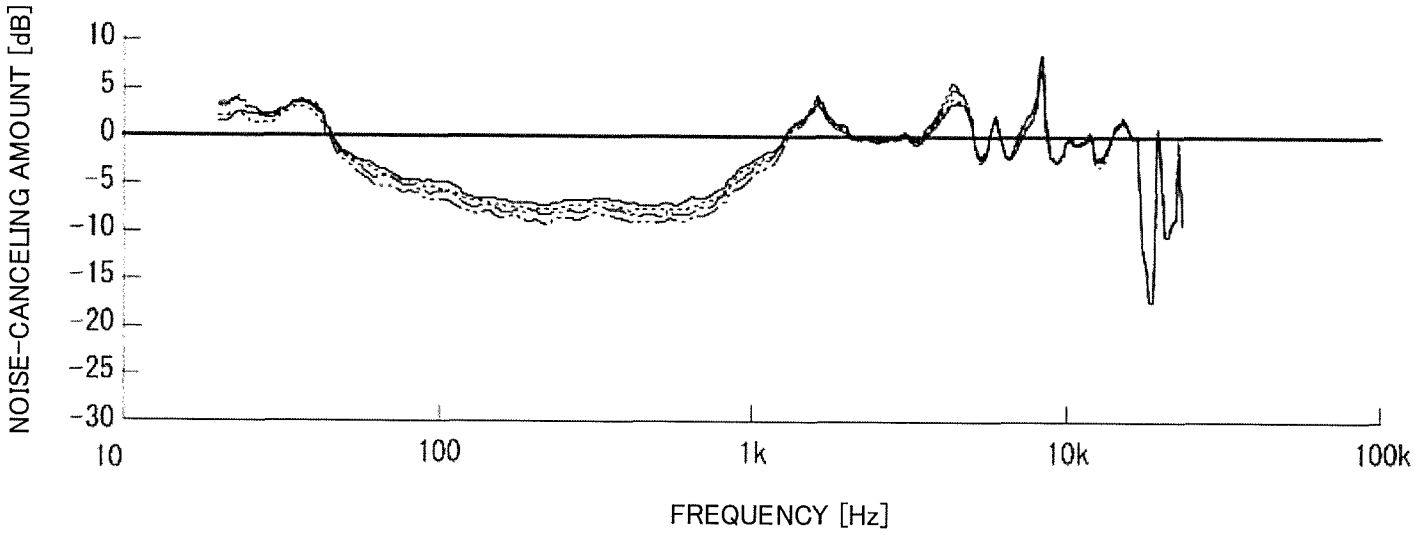
FIG. 4 shows noise-canceling performance of a conventional headphone measured by using a dummy head.
Figure 5:
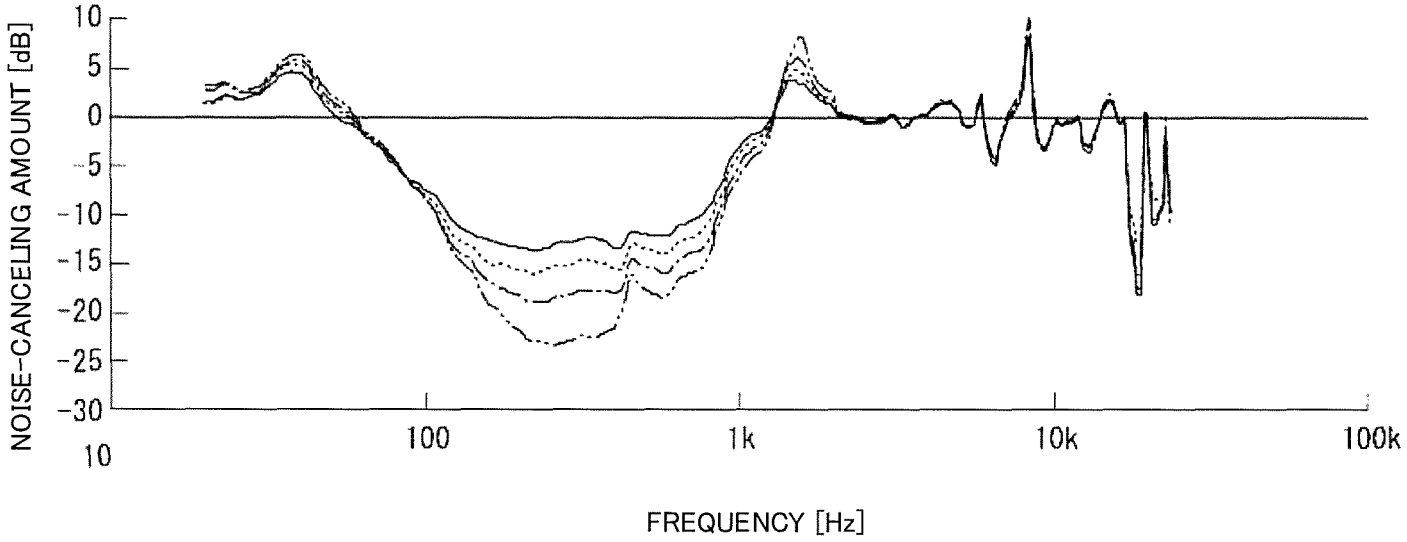
FIG. 5 shows noise-canceling performance of the headphone according to the exemplary embodiment measured by using the dummy head.

FIGS. 4 and 5 show the noise-canceling performance of headphones measured by using the dummy head H. FIG. 4 shows the noise-canceling performance of a conventional headphone with the feedback microphone 12 but without the balanced microphone 13. FIG. 5 shows the noise-canceling performance of the headphone 1 according to the exemplary embodiment with the feedback microphone 12 and the balanced microphone 13.

The horizontal axes indicate frequency and the vertical axes indicate the noise-canceling amount in FIGS. 4 and 5. The solid lines in FIGS. 4 and 5 show the noise-canceling amount when the gain of the feedback microphone 12 is set to 10 dB, the broken lines show the noise-canceling amount when the gain of the feedback microphone 12 is set to 11 dB, the one-dot chain lines show the noise-canceling amount when the gain of the feedback microphone 12 is set to 12 dB, and the two-dot chain lines show the noise-canceling amount when the gain of the feedback microphone 12 is set to 13 dB.

Although the noise-canceling amount tends to increase as the gain of the feedback microphone 12 increases, in FIG. 4, the noise-canceling amount barely changes after the gain of the feedback microphone 12 exceeds 10 dB. This is considered to be the result of an occurrence of a loop state where the noise-canceling sound B1 is generated by inverting the signal including the signal based on the attenuated noise-canceling sound B2 received by the feedback microphone 12.

On the other hand, the noise-canceling amount increases as the gain of the feedback microphone 12 increases beyond 10 dB in the case of FIG. 5. This may be because the signal component based on the attenuated noise-canceling sound B2 input into the feedback microphone 12 remains small, since the signal based on the attenuated noise-canceling sound B2 received by the feedback microphone 12 is canceled by the attenuated signal B4 based on the inverted noise-canceling sound B3 of the opposite phase received by the balanced microphone 13.

As a result of the small signal component based on the attenuated noise-canceling sound B2 input into the feedback microphone 12, the ratio of the signal component based on the attenuated noise-canceling sound B2 to the signal component based on the external sound A input into the inverter 214 decreases as the gain of the feedback microphone 12 increases. Therefore, the noise-canceling effect realized by increasing the gain of the feedback microphone 12 is likely to improve.

[Comparison of Each System]

Figure 6:
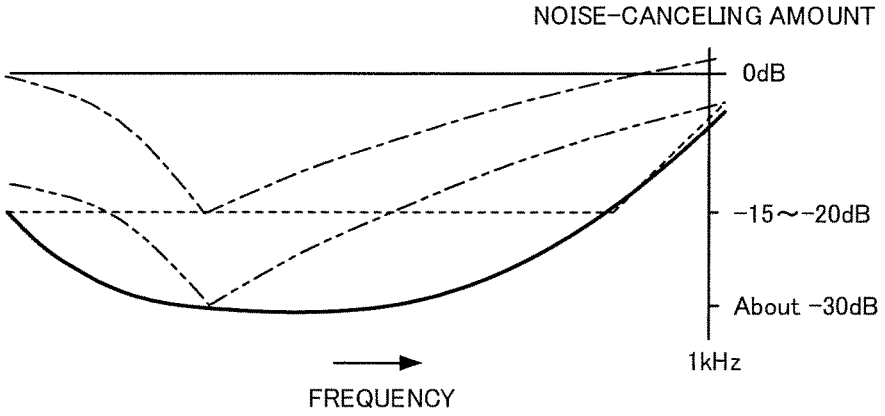
FIG. 6 schematically shows noise-canceling performance of various noise-canceling systems of headphones.

FIG. 6 schematically shows noise-canceling performance of various noise-canceling systems of a headphone. In FIG. 6, the noise-canceling performance of a feedback system, a feedforward system, and a hybrid system that are known as noise-canceling systems of the headphone, as well as the noise-canceling performance of the system according to the exemplary embodiment, are shown. The horizontal axis of FIG. 6 indicates the frequency, and the vertical axis indicates the amount of residual noise received by the measurement microphone 3 that is capable of being cancelled when measured by the method shown in FIG. 3.

The broken line in FIG. 6 shows the magnitude of the residual noise included in the sound emitted from a headphone adopting the feedback system. In this system, an approximately constant amount of noise is cancelled regardless of the frequency, and thus the magnitude of the residual noise is kept fixed.

The one-dot chain line in FIG. 6 shows the magnitude of the residual noise included in the sound emitted from a headphone adopting the feedforward system. In the feedforward system, noise can be canceled by collecting noise with a microphone provided on the outside of the headphone and predicting the change in the noise signal until reaching the ear to generate a noise-canceling signal. It is shown that the residual noise of this system is smaller in a specific frequency, but the residual noise is larger in other frequencies compared to the feedback system.

The two-dot chain line in FIG. 6 shows the magnitude of the residual noise included in the sound emitted from a headphone adopting the hybrid system in which the feedback system and the feedforward system are combined. In this system, influence of the feedforward system is dominant, and the residual noise is smaller than that of the feedback system in a specific frequency range, but the residual noise is larger than that of the feedback system in other frequencies. This results in giving the user uncomfortable feeling or unpleasant feeling.

The solid line in FIG. 6 shows the magnitude of the residual noise included in the sound emitted from a headphone having the feedback microphone 12 and the balanced microphone 13 according to the exemplary embodiment. In this system, it is shown that the residual noise is smaller than that of the other systems in a broader range of frequencies.

[Variation 1]

In the above-mentioned explanation, configurations are described in which the signal based on the external sound A generated by the adder 212 is amplified in the amplifier 213, and the inverter 214 inverts the amplified signal A1 generated by the amplifier 213. The order of the amplifying process in the amplifier 213 and the inverting process in the inverter 214 may be reversed. That is, the signal based on the external sound A generated by the adder 212 may be inversed by the inverter 214 and then amplified by the amplifier 213. Also, the inverter 214 may have the amplifying function of the amplifier 213.

[Variation 2]

In the above-mentioned explanation, a configuration in which one feedback microphone 12 and one balanced microphone 13 are provided in the ear cup 2 was illustrated as an example, but a plurality of the feedback microphones 12 may be provided. Also, a plurality of the balanced microphones 13 may be provided in the ear cup 2.

Figure 7A:
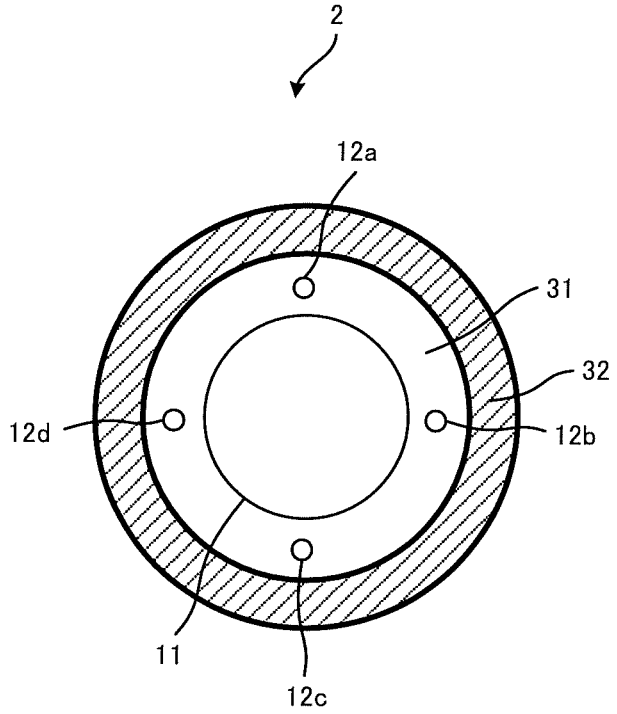
FIGS. 7A and 7B each show a variant example of the ear cup.
Figure 7B:
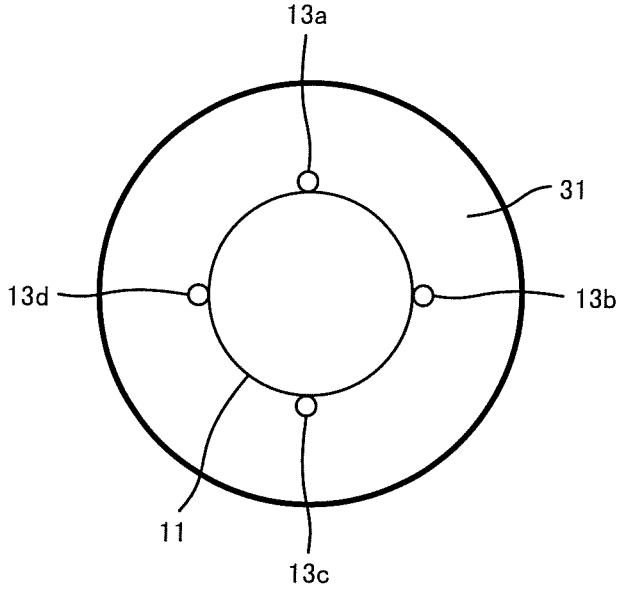

FIGS. 7A and 7B each show a variant example of the ear cup 2. FIG. 7A shows an example of the ear cup 2 provided with a plurality of feedback microphones 12 (12*a*, 12*b*, 12*c*, 12*d*). In the example of FIG. 7A, the feedback microphones 12 are provided on a concentric circle with a center matching a center position of a diaphragm of the driver unit 11. The feedback microphones 12 are provided, for example, at even intervals on a concentric circle with a center matching a center position of a diaphragm of the driver unit 11. The adder 212 adds an average value or a median value of a plurality of attenuated noise-canceling sounds B2 input from the feedback microphones 12 and the attenuated signal B4 input from the attenuator 211. Because the adder 212 uses the mean value or the median value of the attenuated noise-canceling sounds B2 in such a manner, the influence due to the variability in the position where the feedback microphone 12 is provided can be reduced, and thus the noise-canceling performance further improves.

FIG. 7B shows an example of the ear cup 2 provided with a plurality of balanced microphones 13 (13*a*, 13*b*, 13*c*, 13*d*). In the example of FIG. 7B, the balanced microphones 13 are provided at even intervals on a concentric circle with a center matching a center position of a diaphragm of the driver unit 11. The attenuator 211 generates the attenuated signal B4 by attenuating an average value or a median value of a plurality of inverted noise-canceling sounds B3 input from the balanced microphones 13. Because the attenuator 211 uses the average value or the median value of the inverted noise-canceling sounds B3, the influence due to the variability in the position where the balanced microphone 13 is provided can be reduced, and thus the noise-canceling performance further improves.

[Effect of Headphone 1 According to the Exemplary Embodiments]

As described above, the headphone 1 according to the exemplary embodiments includes the driver unit 11, the feedback microphone 12, the balanced microphone 13, the attenuator 211, the adder 212, and the inverter 214. The balanced microphone 13 receives the noise-canceling sound input from the driver unit 11, and the attenuator 211 attenuates the electrical signal based on the noise-canceling sound. Then, the adder 212 adds the attenuated noise-canceling signal being attenuated in the attenuator 211 to the electrical signal based on the sound received by the feedback microphone 12, and the inverter 214 generates the noise-canceling signal by inverting the added signal. Configured in such a manner, the noise-canceling performance of the headphone 1 improves because influence of the noise-canceling sound that enters the feedback microphone 12 is suppressed, and the noise-canceling sound that cancels the external sound can be generated.

The present invention is explained on the basis of the exemplary embodiments. The technical scope of the present invention is not limited to the scope explained in the above embodiments and it is possible to make various changes and modifications within the scope of the invention. For example, the specific embodiments of the distribution and integration of the apparatus are not limited to the above embodiments, all or part thereof, can be configured with any unit which is functionally or physically dispersed or integrated. Further, new exemplary embodiments generated by arbitrary combinations of them are included in the exemplary embodiments of the present invention. Further, effects of the new exemplary embodiments brought by the combinations also have the effects of the original exemplary embodiments.

For example, although a case where only the noise-canceling sound B1 is emitted from the driver unit 11 is shown as an example in the above-mentioned explanation, a musical tone may be emitted together with the noise-canceling sound B1 from the driver unit 11. Also, in the above-mentioned explanation, the headphone 1 adopting the feedback system was shown as an example, but the present invention may be applied to a headphone adopting the hybrid system.

What is claimed is:

1. A headphone comprising:

a first microphone that receives a front air chamber sound including an external sound, the first microphone being provided on a front air chamber side;

a driver unit that emits a noise-canceling sound into the front air chamber, the noise-canceling sound canceling at least a part of the external sound included in the front air chamber sound received by the first microphone;

a second microphone that receives an inverted noise-canceling sound whose phase is opposite to the phase of the noise-canceling sound emitted from the driver unit and received by the first microphone, the second microphone being provided in a region on a side of the driver unit opposite the front air chamber; and a sound generating part that generates the noise-canceling sound by adding a signal based on the inverted noise-canceling sound received by the second microphone to a signal based on the front air chamber sound received by the first microphone, wherein a distance between the second microphone and a center position of the driver unit is less than a distance between the first microphone and the center position of the driver unit.

2. The headphone according to claim 1, wherein the second microphone is provided in a region on a side of the driver unit opposite the first microphone.

3. The headphone according to claim 1, wherein the second microphone is provided at a position included in an area where a diaphragm of the driver unit is provided, the area being on a back surface of the driver unit.

4. The headphone according to claim 3, wherein the second microphone is fixed to the driver unit near a center position of the diaphragm, the center position being on a back side of the diaphragm.

5. The headphone according to claim 1, wherein the sound generating part has:

an attenuator that attenuates the inverted noise-canceling sound received by the second microphone;

an adder that adds together a signal based on the front air chamber sound received by the first microphone and a signal that has been attenuated in the attenuator; and an inverter that inverts a signal resulting from the adding by the adder.

6. The headphone according to claim 5 comprising a plurality of the first microphones, wherein the adder adds together an average value or a median value of a plurality of signals based on the front air chamber sound received by the first microphones and the attenuated signal that has been attenuated in the attenuator.

7. The headphone according to claim 5, wherein an amount of attenuation of the attenuator is equivalent to an amount that the noise-canceling sound emitted from the driver unit is attenuated before reaching the first microphone.

8. The headphone according to claim 5, wherein an attenuation rate of the attenuator is a value obtained by dividing the magnitude of an attenuated noise-canceling sound, which is the noise-canceling sound, emitted from the driver unit, at the time of reaching the first microphone, by the magnitude of the noise-canceling sound.

9. The headphone according to claim 8, wherein the attenuator generates an attenuated signal that has the same frequency as, the same level as, and an opposite phase of a signal based on the attenuated noise-canceling sound by attenuating the inverted noise-canceling sound input form the second microphone.

10. The headphone according to claim 5, wherein the sound generating part further has an amplifier that generates an amplified signal whose level is equal to a residual noise level in the front air chamber by amplifying a signal based on a sound input from the adder.

11. The headphone according to claim 10, wherein the inverter generates the noise-canceling sound by inverting a signal input from the amplifier.

12. The headphone according to claim 1, comprising a plurality of the first microphones that receive a front air chamber sound including an external sound, the plurality of the first microphones being provided on the front air chamber side.

13. The headphone according to claim 12, wherein the plurality of first microphones are provided on a concentric circle with a center matching a center position of a diaphragm of the driver unit.

14. The headphone according to claim 13, wherein the plurality of first microphones are provided at even intervals on a concentric circle with a center matching the center position of the diaphragm of the driver unit.

15. The headphone according to claim 1, wherein the second microphone is embedded in the driver unit.

* * * * *